US005622456A

United States Patent [19]

Risi et al.

[11] Patent Number: 5,622,456

[45] Date of Patent: Apr. 22, 1997

[54] RETAINING WALL BLOCKS

[75] Inventors: Angelo Risi; Antonio Risi, both of Richmond Hill, Canada

[73] Assignee: Rothbury Investments Ltd., Thornhill, Canada

[21] Appl. No.: 408,785

[22] Filed: Mar. 23, 1995

[51] Int. Cl.[6] ..... E02D 29/02

[52] U.S. Cl. ..... 405/284; 405/286; 405/262; 52/604

[58] Field of Search ..... 405/284, 286, 405/273; 52/604, 605, 606, 607, 608, 570, 599

[56] References Cited

U.S. PATENT DOCUMENTS

| | | | |
|---|---|---|---|
| D. 311,444 | 10/1990 | Forsberg | D25/113 |
| 4,490,015 | 12/1984 | Risi et al. | 405/273 |
| 4,490,075 | 12/1984 | Risi et al. | 405/273 |
| 5,294,216 | 3/1994 | Sievert | 405/286 |

FOREIGN PATENT DOCUMENTS

| | | |
|---|---|---|
| 2019033 | 12/1991 | Canada . |
| 2127872 | 4/1984 | United Kingdom . |

*Primary Examiner*—Henry A. Bennett
*Assistant Examiner*—Pamela A. O'Connor
*Attorney, Agent, or Firm*—Robic

[57] ABSTRACT

Retaining wall blocks are disclosed, which are trapezoidal in shape and have a positive interlock. These blocks can be used to construct walls, especially garden walls, that are strong and either straight or serpentine, with concave or convex surfaces. More particularly, the blocks, thanks to their structure, can be used to construct tree rings or wells, patio walls with or without corners, straight walls with curved ends, serpentine feature walls, L-shaped walls, lawn and driveway edgings, small steps, free-form shallow ponds, planter boxes, window wells and the like. Advantageously, they can be produced in the form of units comprising blocks of the same or different type, e.g. of the stacking, coping or corner type, which can be assembled in the form of very light bundles easy to store and transport.

16 Claims, 8 Drawing Sheets

RETAINING WALL BLOCKS

BACKGROUND OF THE INVENTION a) Field of the Invention

The present invention relates to retaining wall blocks that can be used as landscaping elements to construct nice-looking, straight or curved retaining walls or edging.

The invention also relates to units made of a plurality of such blocks integrally connected to each other in line.

b) Brief Description of the Prior Art

Retaining wall blocks, also called "garden stones", are well known products that are commonly used to construct earth retaining wall structure, terrace walls, patio or side walk edging, flower bed borders and the like.

In Canadian patent No. 941,626 issued in 1974 to Giuseppe RISI, there is disclosed a concrete molded block of rectangular shape, provided with a groove extending centrally across its bottom flat surface and with a matching tongue extending centrally across its top flat surface. In use, these blocks can be stacked onto similar blocks extending in line with the tongues of the underlying blocks extending into the grooves of the overlying blocks. Since these tongues and grooves are centrally positioned, the front surfaces of all the stacked blocks extend in a same plane.

In Canadian patent No. 1,182,295 issued to the present inventors, it is suggested to shift the tongues and grooves of blocks like those disclosed in Canadian patent No. 941,626, so that each row of blocks stacked onto another row of blocks extending below, is automatically uniformly set back from the next below row of blocks.

In both cases, the blocks that are stacked can be slid laterally with respect to each other but cannot be slid forwards or rearwards because of their tongue-and-groove connection. Such a locking of the blocks against any transversal displacement substantially reinforce the wall in the direction where it is the most subject to deformation. However, because of their rectangular shape, the blocks disclosed in both of the above mentioned patent can only be used to construct straight walls.

To solve this problem, Canadian laid-open patent application No. 2,019,033 published in 1991 in the name of BLOCK SYSTEMS INC. discloses a retaining wall block of trapezoidal shape, having a locking that extend downwardly at the rear of its bottom surface. Due to the trapezoidal shape of the blocks, one may construct not only straight wall but also inwardly or outwardly curved wall. However, because of the very specific position of the locking flange, any wall that is built from such blocks is necessarily inclined, because every horizontal row of blocks is automatically set back from the adjacent row of blocks extending below.

U.S. Pat. No. DE 311,444 of 1990 in the name of Paul J. FORSBERG discloses a retaining wall block of trapezoidal shape, that can also be used to construct straight or serpentine walls. Depending on the relative angular position of the blocks of each horizontal course of blocks with respect to each other, one may indeed build a straight or serpentine wall with convex and/or concave surface. In this design patent, no reference is made to locking means to connect each horizontal row of blocks to the next underlying row. However, holes and cavities are provided in the blocks, probably for the purpose of connecting such locking means thereto.

SUMMARY OF THE INVENTION

The object of the present invention is to provide a retaining wall block which combines the structure and advantages of the interlocking blocks disclosed in the above mentioned Canadian patent Nos. 941,626 and 1,182,295, with the trapezoidal shape and advantages of the blocks disclosed in Canadian laid-open application No. 2,019,033 and U.S. Pat. No. DE 311,444.

The retaining wall block according to the invention basically comprises:

top and bottom surfaces that are flat and parallel to each other, each of these top and bottom surfaces being trapezoidal in shape and symmetrical with respect to a vertical plane and preferably having bevelled edges;

front and rear surfaces that are transversal to the Vertical plane and substantially parallel to each other;

left-hand side and right-hand surfaces that are flat and extend at given angles that are opposite to each other with respect to the vertical plane, respectively, and a groove of given depth and width that extends into the bottom surface perpendicularly to the vertical plane at middle distance from the front and rear surfaces between the left-hand and right-hand side surfaces.

This block with a flat top surface is essentially useful as a "coping" block, to provide a nice-looking, flat aspect to the top surface of a wall formed of horizontal rows of other blocks of the very same structure, but provided with locking tongues projecting from their top walls.

In accordance with the invention, these other blocks, hereinafter called "stacking blocks", each have a tongue that projects from their top surface in a direction generally perpendicular to the vertical plane, between their left-hand side and right-hand side surfaces. The tongue must have a height equal to or smaller than the depth of the groove. The tongue must also have a width of varying size, which, at middle distance from the left-hand side and right-hand side surfaces, is substantially equal to or slightly smaller than the width of the groove, and which becomes smaller in size toward each of the left-hand side and right-hand side, respectively.

Thereby any other similar block can be stacked onto the block disclosed hereinabove with the tongue of this block inserted into the groove of the other block and with the front surfaces of both of the blocks extending either parallel or at an angle with respect to each other as a function of the position given to the tongue within the groove of the other block. Thus, it becomes possible to construct straight or serpentine walls wherein each horizontal row of blocks is positively interlocked with the underlying row of blocks.

In accordance with a preferred embodiment of the invention, the tongue of the stacking block is diamond-shaped and has a long axis that extends perpendicular to the vertical plane of the block, a short axis that extend within the vertical plane, and a pair of opposite apexes on this long axis that are cut into flat portions that are coplanar with said left-hand side and right-hand side surfaces of the block respectively.

Advantageously also, the tongue extends at middle distance from the front and rear surfaces of the block respectively. Thereby, when another similar block is stacked onto the block with the tongue of this block inserted into the groove of this other block and with the front surfaces of both of these blocks extending parallel, these front surfaces are coplanar.

With such a positioning of the tongue, it becomes also possible to construct a straight wall with no space left between each block, by merely "inverting" the adjacent blocks so that one block has its front surface forwards while the next adjacent block has its rear surface forwards. As a result, all the adjacent surfaces of the blocks on the front and rear surface of the erected wall will extend adjacent in same plane, respectively. By the way, this is the reason why both the front and rear surfaces of each block should preferably be rock-faced.

The invention also provides a multiple retaining wall block comprising at least two blocks as defined above that are integrally connected to each other in line with the front or rear surface of each block extending flat against the front or rear surface of every adjacent block, respectively. In such cases, the bevelled edges of the front and rear surfaces of each block make it possible for the same to be slitted and cut off from the remaining blocks.

Preferably, the unit also comprises a pair of end pieces forming an integral part thereof. These end pieces extend flat against the front or rear surfaces of the blocks that extend at both ends of the unit and have a height slightly smaller than the height of the blocks. Thereby, these end pieces can be slitted and cut off directly from a bundle of similar units of the above mentioned type, stacked on each other.

As can now be better understood, the invention provides new retaining wall blocks that are trapezoidal in shape and have a positive interlock. Such blocks can be used to construct walls, especially garden walls, that are strong and either straight or serpentine, with concave or convex surface. More particularly, such blocks, thanks to their structure, can be used to construct tree rings or wells, patio walls with or without corner, straight walls with curved ends (e.g. end of a driveway), serpentine feature walls (e.g. setting wall), L-shaped walls, lawn and driveway edgings, small steps, free-form shallow ponds, planter boxes, window wells and the like.

Advantageously, they can be produced in the form of units comprising blocks of the same or different type (e.g. stacking, coping or corner type), which can be assembled in the form of very tight bundles easy to store and transport.

BRIEF DESCRIPTION OF THE DRAWING

The invention and its advantages will be better understood upon reading of the following, non-restrictive description of a preferred embodiment thereof, made with reference to the accompanying drawings in which.

DESCRIPTION OF A PREFERRED EMBODIMENT OF THE INVENTION

Figure 1:
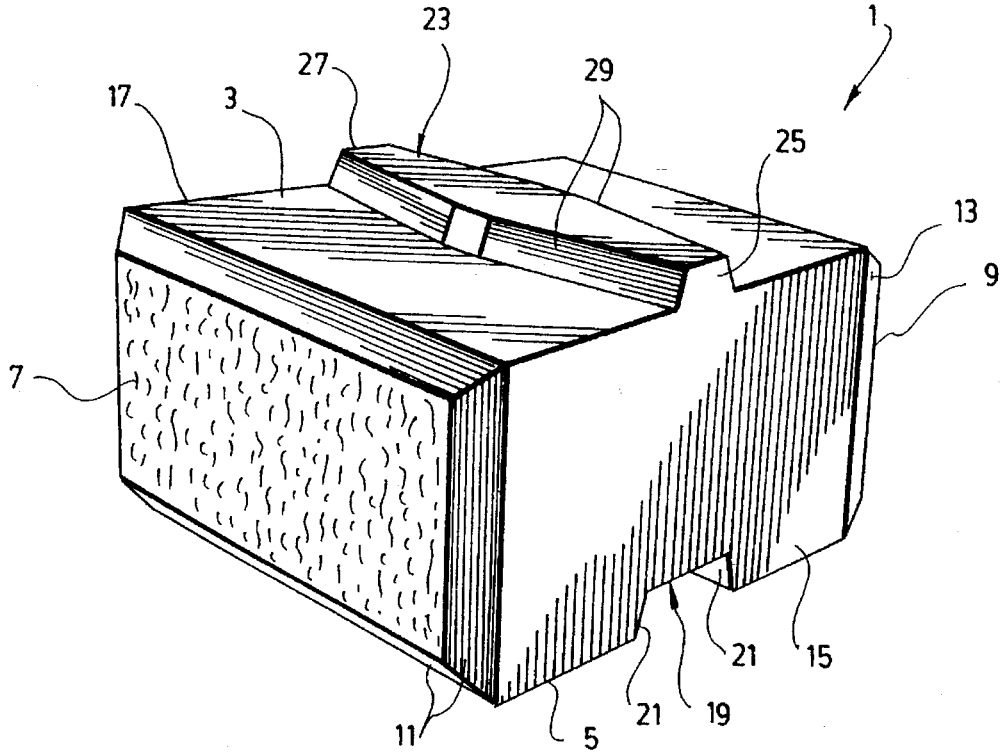
FIG. 1 is a front perspective view of a retaining wall block according to the invention, which is of the "stacking" type and thus can be stacked onto similar blocks.

The retaining wall blocks 1 and 11 according to the invention as shown in FIGS. 1 to 6 of the drawings are intended to be used to construct retaining walls. These blocks which are preferably made of mortar or concrete, have numerous similar structural elements. For the purpose of simplicity, the same reference numerals have been used in the following description to identify the same structural elements.

Thus, each block 1 or 1' has a top surface 3 and a bottom surface 5 that are flat and parallel to each other. Each of these top and bottom surfaces 3, 5 are trapezoidal in shape and symmetrical with respect to a vertical plane "P". Each block 1 or 1' also has a front surface 7 and a rear surface 9 that are transversal to the vertical plane "P" and substantially parallel to each other. Because of the trapezoidal shape of the top and bottom surfaces 3 and 5, the front surface 7 is longer than the rear surface 9. Both of these front and rear surfaces 7, 9 preferably have bevelled edges 11, 13 and a rock-shaped aspect.

Figure 2:
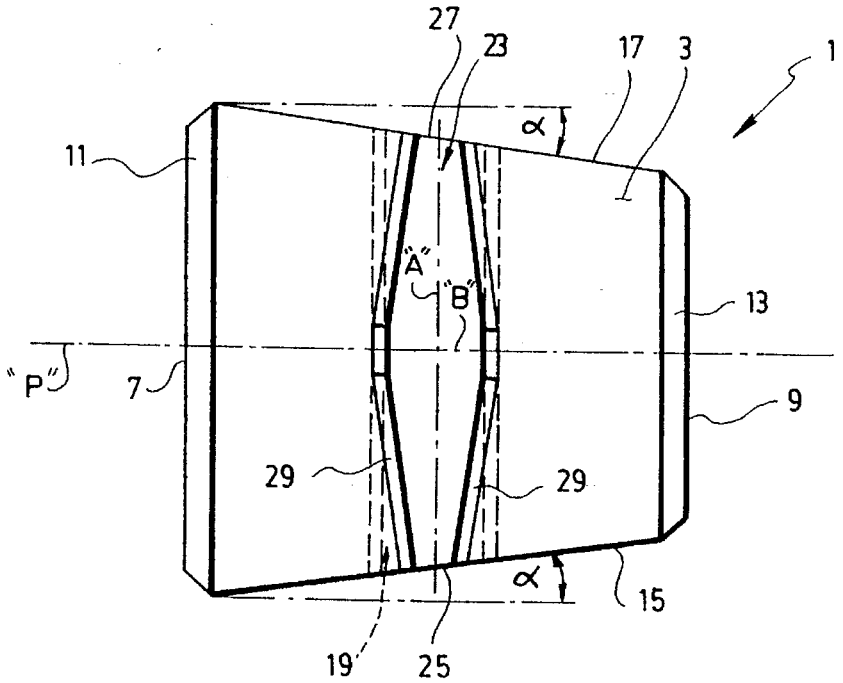
FIG. 2 is a top plan view of the block shown in FIG. 1.
Figure 5:
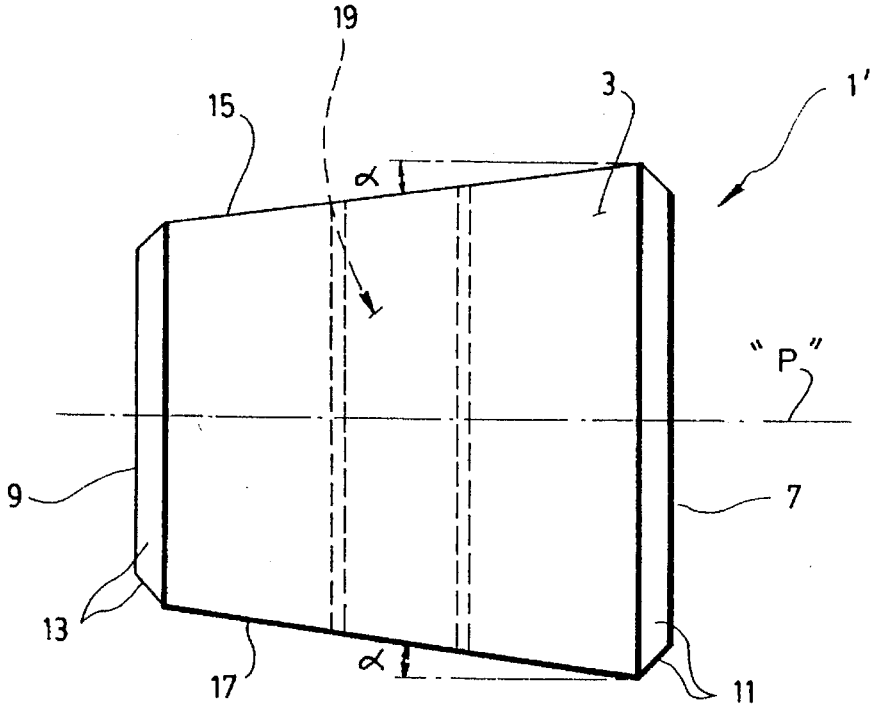
FIG. 5 is a top plan view of the block shown in FIG. 4.

Each block 1 or 1' further has tapering left-hand side and right-hand side surfaces 15, 17 that are flat and extend at given angles $\alpha$ that are opposite to each other with respect to the vertical plane "P" respectively. These angles a that are shown in FIGS. 2 and 5, are preferably equal to 8°. However, any other angle could be selected, if desired.

Each block 1 or 1' further has a groove 19 of given depth "d" and width "w" (see FIG. 3) that extends into the bottom surface 5 perpendicularly to the vertical plane "P" at middle distance from the front and rear surfaces 7, 9 between the left-hand side and right-hand side surfaces 15, 17. As is shown, the groove 19 preferably has tapering side walls 21 to make it easier to mould.

The block 1' comprises the above structural elements, exclusively. Block 1' is a "coping block", which is intended to be mounted on top of a retaining wall made of blocks 1 so as to provide a nice-looking, flat surface on top of this wall. As may be understood, this nice-looking, flat surface is the "combination" of the flat top surfaces 3 of the coping blocks 1' that extend adjacent to each other on top of the retaining wall.

Block 1 is the standard "stacking block" that is used to construct the retaining wall. This stacking block 1 differs from the coping block 1' in that it further comprises a tongue 23 projecting from its top surface 3 in a direction generally perpendicular to the vertical plane "P" between the left-hand side and right-hand side surfaces 17 and 19. As is either shown in FIG. 2, the tongue 23 is diamond-shaped and has a long axis "A" that extends perpendicular to the vertical plane P a short axis "B" that extend within the vertical plane "P" and a pair of opposite apexes on the long axis "A" that are cut into flat portions 25, 27 that are coplanar with the left-hand side and right-hand side surfaces 15 and 17 respectively.

It is not compulsory that the tongue 23 be diamond-shaped, eventhough this is preferred. As a matter of fact, the tongue could be ellipsoidal. However, it is compulsory that this tongue 23 has a height "h" (see FIG. 3) equal to or small than the depth "h" of the groove 19. It is also compulsory that the tongue 23 has a width "w'" of varying size, which, at middle distance from the left-hand side and right-hand side surfaces, is substantially equal to or slightly smaller than the width "w" of the groove 19, and which becomes smaller in size toward each of the left-hand side and right-hand sides 15 and 17, respectively.

Figure 12:
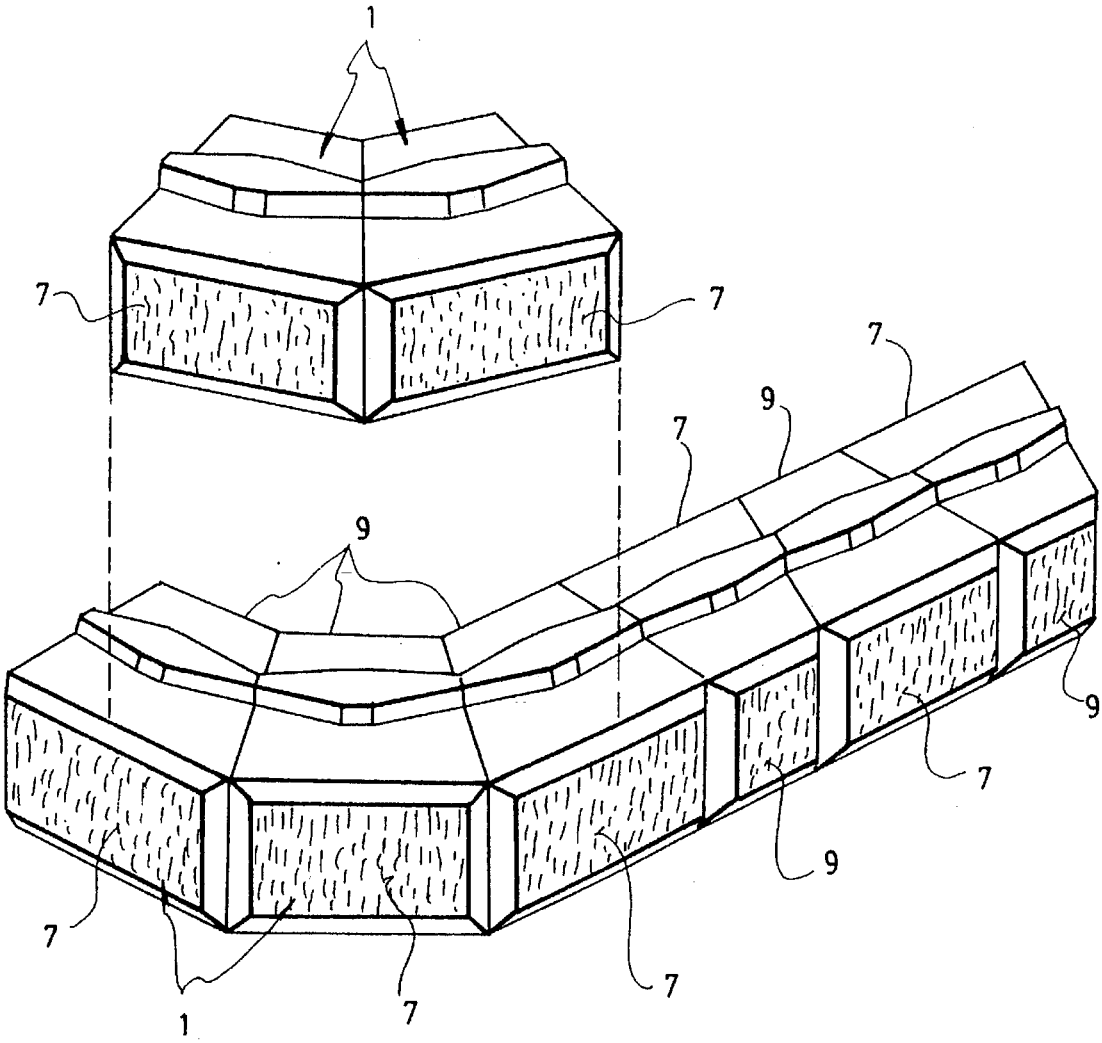
FIG. 12 is an exploded perspective view of a retaining wall showing how the blocks shown in FIGS. 1 to 3 can be used and stacked one above the other along straight lines or curves.
Figure 13:
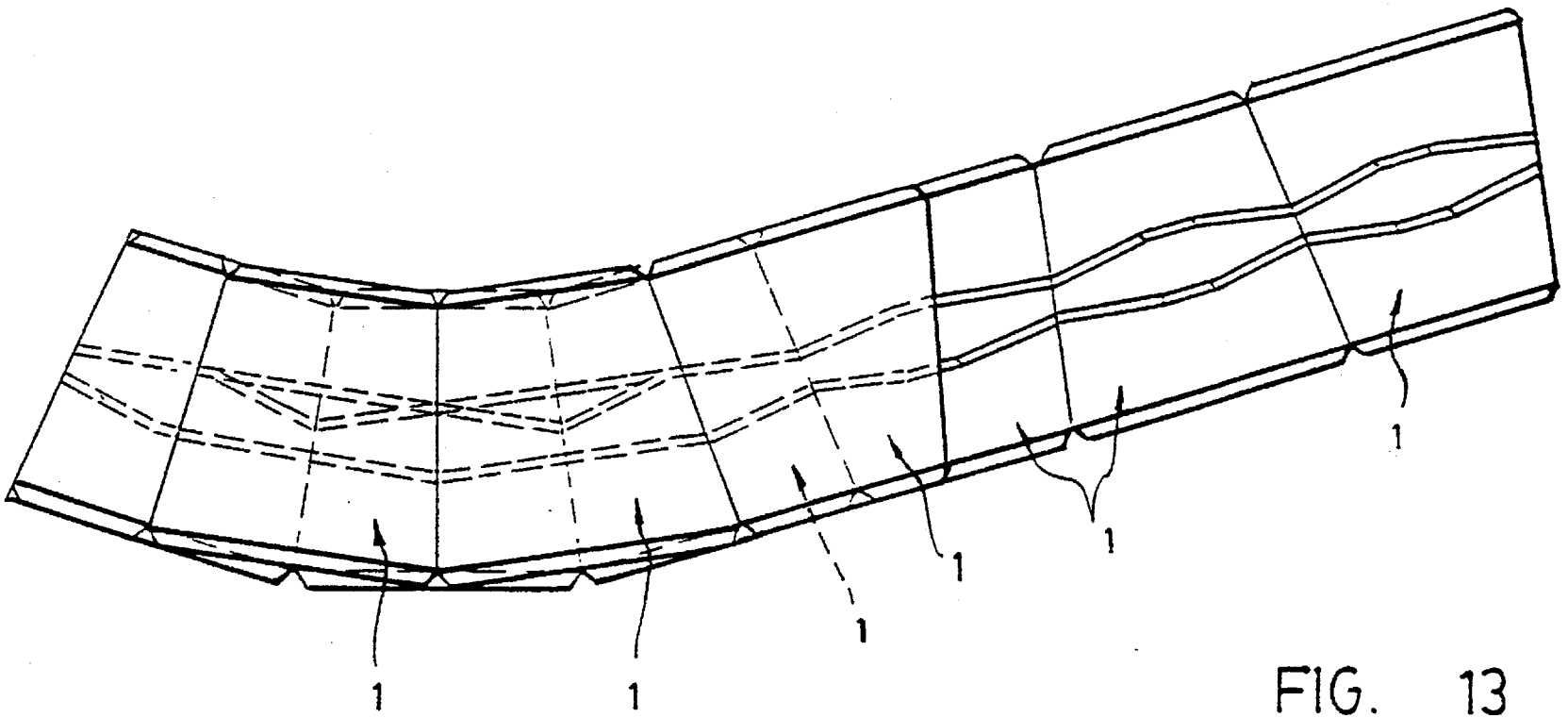
FIG. 13 is a top perspective view of a retaining wall similar to the one shown in FIG. 12, on top of which two coping blocks as shown in FIGS. 4 to 6 are mounted.

Thereby, another block 1 or a coping block 1' can be stacked onto the block 1 with the tongue 23 of the block 1 inserted into the groove 19 of the other block 11 or 1' and with the front surfaces of both of these stacked blocks extending either parallel or at an angle with respect to each other as a function of the position given to the tongue 23 within the groove 19 of the other block 1 a or 1' (see FIGS. 12 and 13).

When the groove 19 has tapering sidewalls 21, the tongue 23 preferably also has sidewalls 29 that taper at a same angle.

Figure 3:
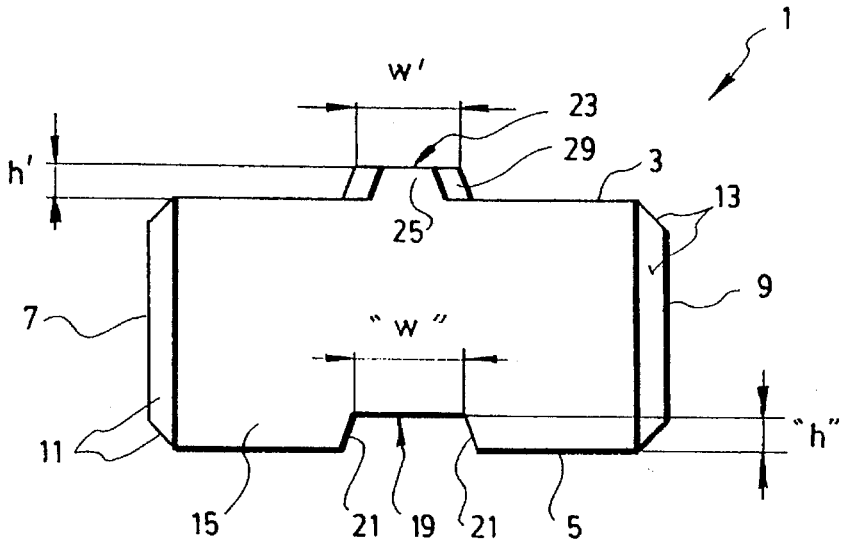
FIG. 3 is a side elevational view of the block shown in FIG. 1.
Figure 4:
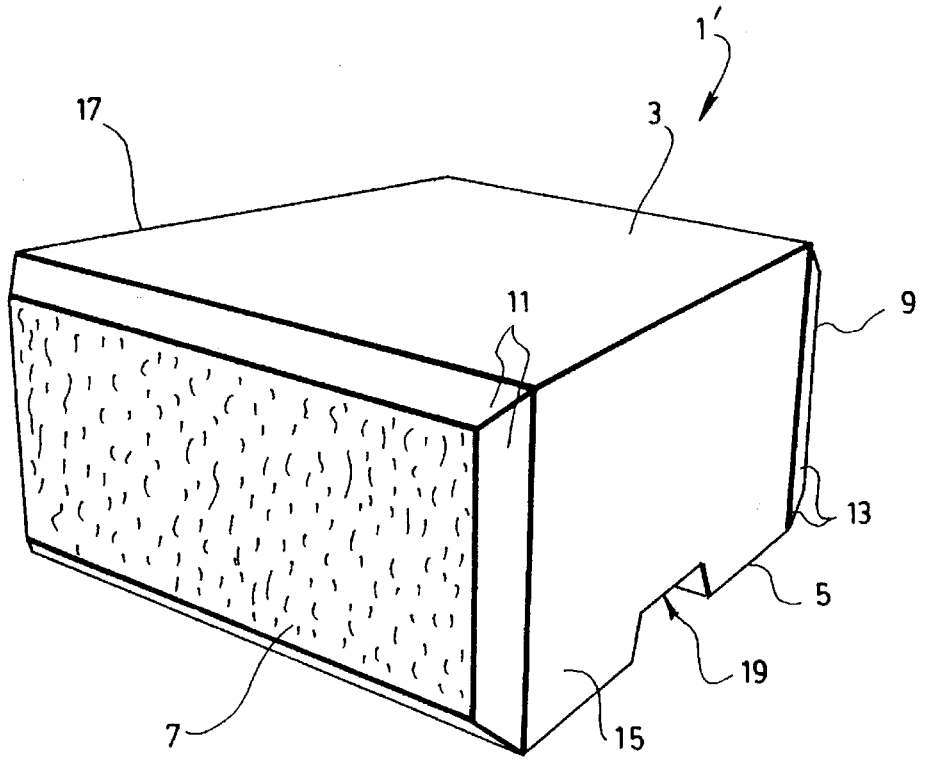
FIG. 4 is a front perspective view of another retaining wall block according to the invention, which is of the "coping" type.
Figure 6:
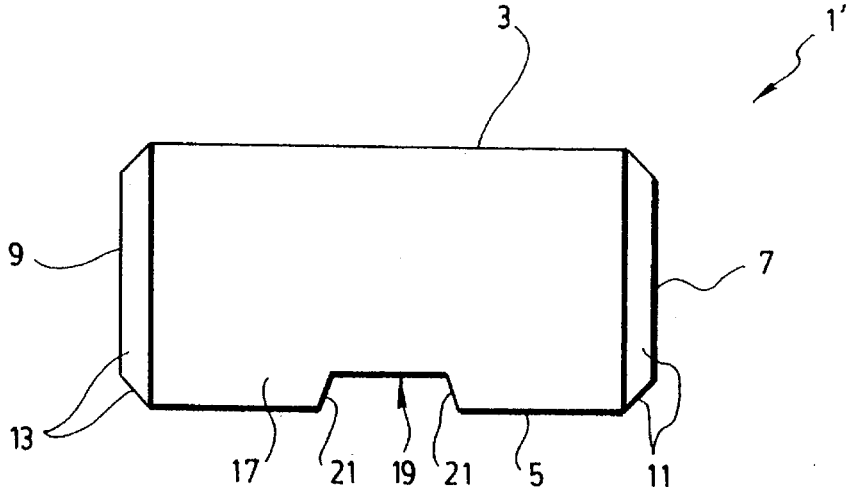
FIG. 6 is a side elevation view of the block shown in FIG. 4.

As is clearly shown in FIG. 3, the tongue 23 advantageously extends at middle distance from the front and rear surfaces 7 and 9 of the block, respectively, so as to be "coplanar" with the groove 19. This feature is particularly interesting in that when another block 1 is stacked onto the block 1 with the tongue 23 of the block 1 inserted into the groove of the other block 1 and with the front surfaces and/or rear surfaces of both blocks 1 extending parallel, these front surfaces are coplanar (see FIG. 13).

The block 1 or 1' according to the invention can be of any size. However, its proportions are preferably selected so that:

the ratio of the length of its front surface 7 to the length of its rear surface 9 is equal to about ⅘;

the ratio of the height of its front and rear surfaces 7, 9 to the length of its front surface 7 is equal to about ½; and the ratio of the length of its front surface 7 to the distance between its front and rear surfaces 7, 9 is equal to about 1.

Thus, for example, the block 1 could have a front surface 7 that would be 20 cm long and 10 cm high. Its rear surface 9 could be 15 cm long and the distance between its front and rear surfaces 7 and 9 could be equal to 20 cm. Its groove 19 could be 1.4 cm deep and have a bottom that would be 4.2 cm wide. Its diamond-shaped tongue 23 could be 1.2 cm high and have a top surface that would be 4.0 cm wide in the middle and 1.8 cm wide at both ends.

Of course, other proportions and/or dimensions could be selected as need be, without departing from the scope of the present invention.

Figure 7:
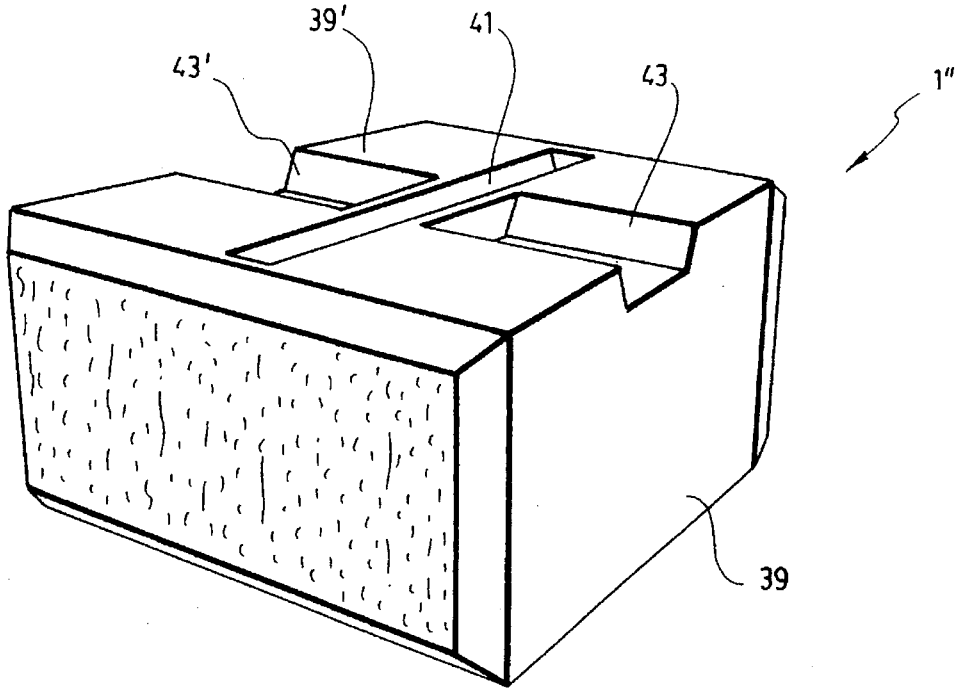
FIG. 7 is a front perspective view of a further block which is of the "combined corner and coping" type and can be used with the blocks shown in FIGS. 1 to 6, this block being shown unsplitted in upside down position.
Figure 8:
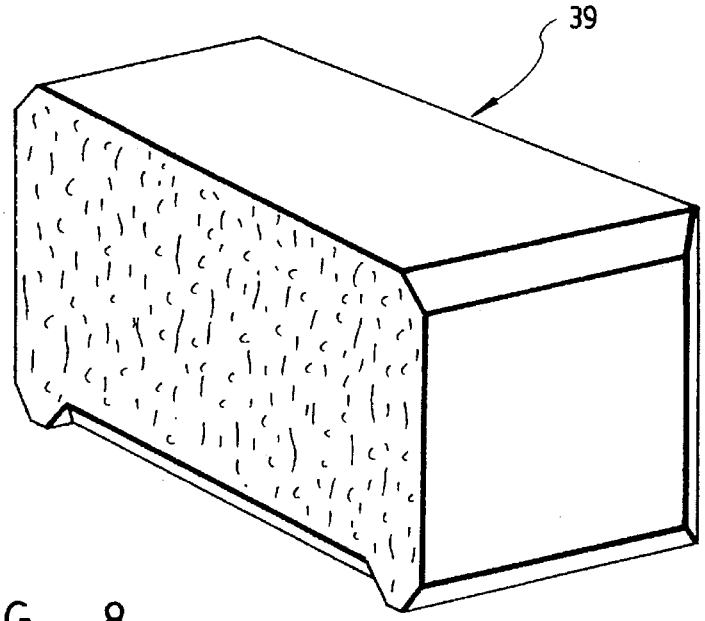
FIG. 8 is a perspective view of one part of the block shown in FIG. 7, after splitting.
Figure 9:
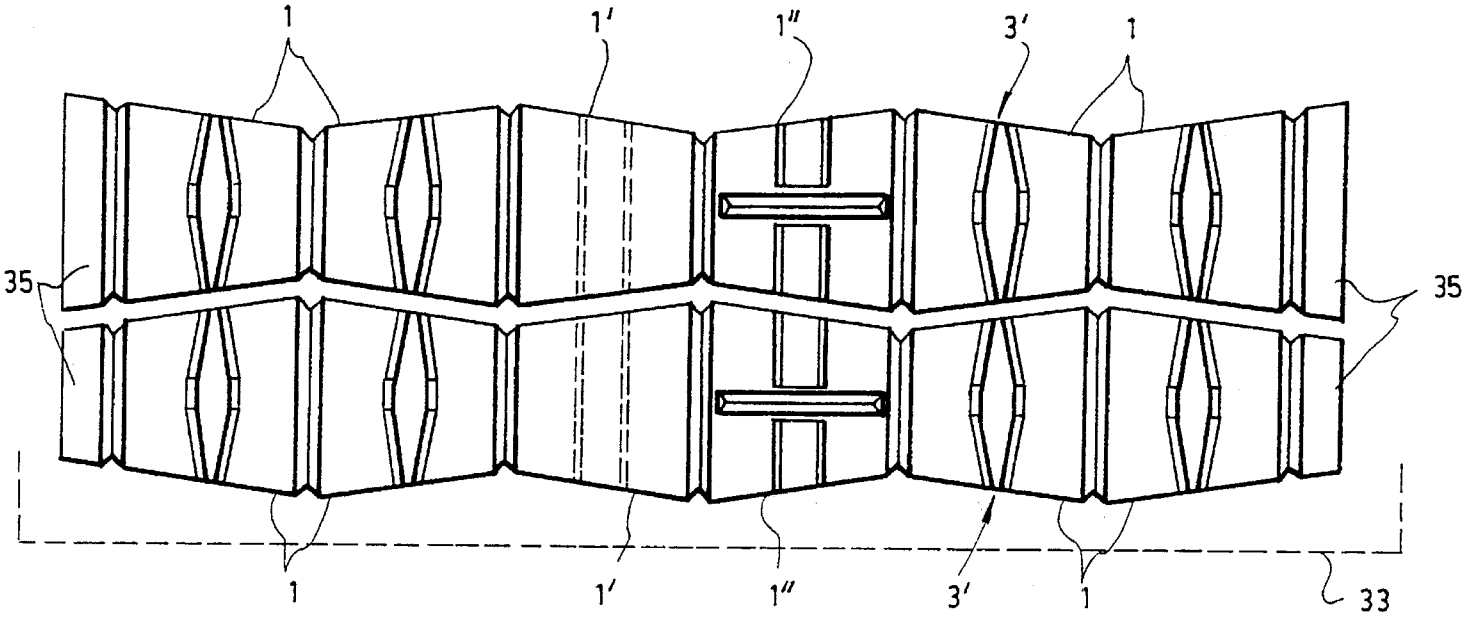
FIG. 9 is a top plan view of two multiple block units each incorporating four blocks as shown in FIG. 1, one block as shown in FIG. 4 and one block as shown in FIG. 7, the units being shown as they stand after ejection from the mould used for their manufacture.
Figure 10:
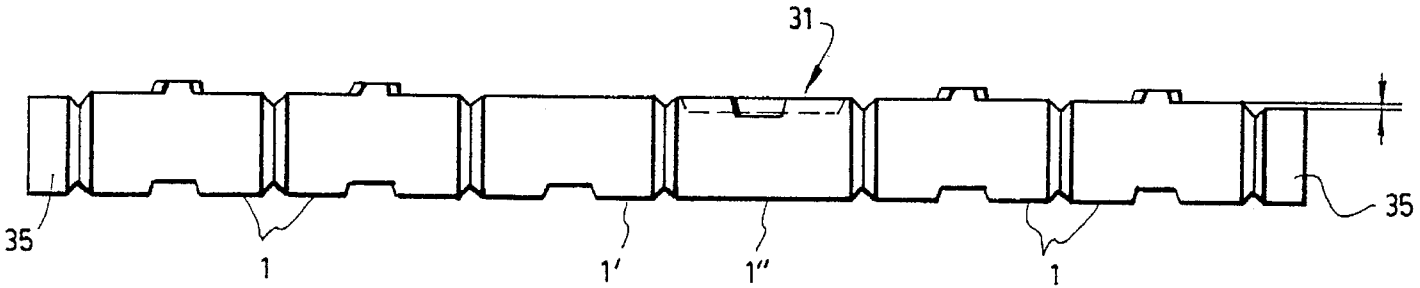
FIG. 10 is a side elevational view of one of the units shown in FIG. 9.

As is shown in FIGS. 9 and 10, the blocks 1 and 1' can be molded in the form of multiple block units 31, 31' each comprising at least two blocks and preferably more than two blocks integrally connected to each other in line with the front or rear surface 7, 9 of each block extending flat against the front or rear surface of every adjacent block, respectively. In the illustrated embodiment, each unit 31, 31' comprises six blocks, viz. four blocks 1 of the stacking type, one block 1' of the coping type, and a further block 1" which is better shown in FIGS. 7 and 8 and will be described in greater detail hereinafter. It must be understood however that each unit could have a different number of blocks that could be of one, two or more types, each in any number.

Figure 11:
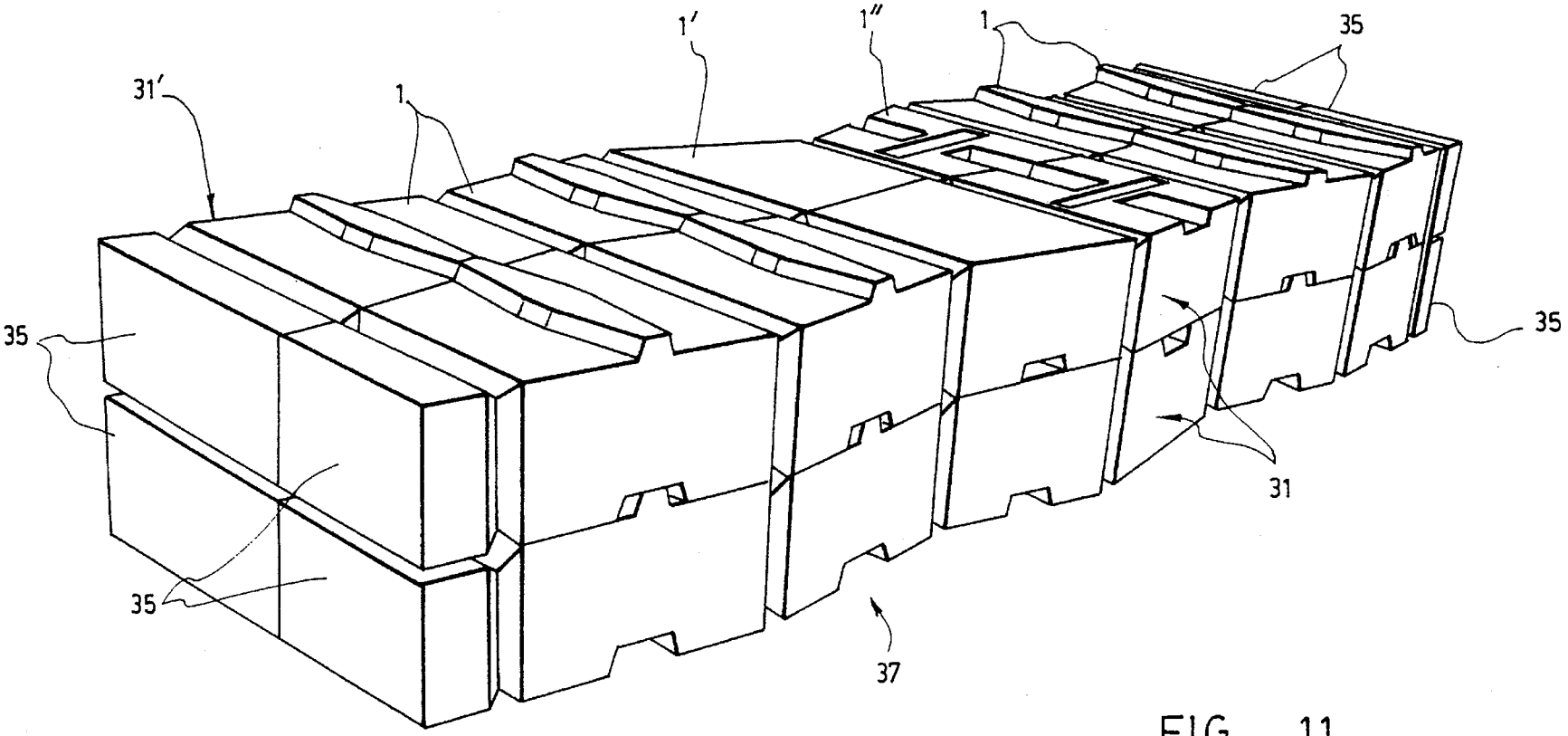
FIG. 11 is a perspective view of a bundle made of four units as shown in FIGS. 9 and 11.

As can be noted, unit 31' is a "mirror copy" of unit 31. Both of them contain the same blocks but in longitudinally inverted position. This feature has several advantages. First of all, it reduces the space that would otherwise be required to have a plurality of blocks molded at the very same time in a same mould. Indeed, if the mould is shaped to produce units 1 and 1' in pair adjacent to each other as is shown in FIG. 9, there would be almost no lost space within this mould (see the dotted line 33 which shows the external contour that the mould could have). Secondly, the fact that the units 31 and 31' are mirror copies of each other make it possible to stacked them in the form of a bundle as is shown in FIG. 11, thereby making the storing and transportation of the blocks much easier to carry out.

As aforesaid, each block 1, 1', 1" of each unit 31, 31' has its front or rear surface connected to the rear or front surface of the adjacent block(s), respectively. Thanks to the presence of bevelled edges on these front and rear surfaces as was disclosed hereinabove, each block or group of blocks can be easily slitted and cut off from the remaining blocks with a hammer and chisel, or alternatively, a circular saw. In this connection, the use of a hammer and chisel is certainly of a greater interest since it causes splitting of the adjacent surfaces of the adjacent blocks by fragmentation and thus gives a nice looking, rock-face aspect to these surfaces. Of course, to give the same rock-face aspect to the front or rear surfaces of the blocks that form the end surfaces of each unit, the same may be molded with a pair of integral end pieces 35 that extend flat against the front or rear surfaces of the end blocks of the unit. Preferably, the end pieces 35 have a height slightly smaller than the height of the adjacent blocks 1. This makes it possible to slit and cut off these end pieces directly from a bundle 37 of stacked units 31, 31' (see FIG. 11).

It is worth mentioning that, after having been broken off, the end pieces 35 of each unit 31, 31' that are thinner than the other blocks can be used as paving stones.

The units 1, 1' that are produced in the mould can, thanks to their shape, be nested into each other both vertically and horizontally, thereby producing a tight and compact bundle 37 (see FIG. 11) that is very easy to transport without damage.

As aforesaid, each unit 1, 1' can include a block 1". This block 1" which is shown in FIGS. 7 to 10, is trapezoidal in shape and of the same height as the blocks 1, 1'. It is intended to be broken off along its main axis, in order to be splitted into two half-blocks 39, 39' that can be used as corner blocks. For this purpose, the block 1" comprises a V-shaped, split-initiating recess 41 on its bottom surface. The block 1" also comprises two closed-ended grooves 43,43' that extend transversally to the recess 41, so as to receive the tongue of any underlying block 1 of the stacking type.

As is shown in FIGS. 12 and 13, the blocks according to the invention make it possible to construct straight or serpentine walls wherein each horizontal row is positively locked to the underlying row, with no automatic, unwanted set-back. The blocks according to the invention can be positioned in such a manner as to avoid gaps, there, by providing a tight fit even around sharp curves.

Blocks of the dimensions disclosed hereinabove can be used to build wall with a 29" outside radius curve. Such blocks weight 18 lbs only and can be easily produced with a standard multilayer paver machine. Their symmetrical geometry and unique interlock ensure perfect fit every time in use. Each block can be easily split from a bundle made of units which are themselves made of several blocks. Such makes the inventory, storing and transportation very easy.

Of course, slight modification could be made to the blocks according to the invention without departing from the scope of the appended claims.

We claim:

1. A retaining wall block comprising:

top and bottom surfaces that are flat and parallel to each other, each of said top and bottom surfaces being trapezoidal in shape and symmetrical with respect to a vertical plane;

front and rear surfaces that are transversal to said vertical plane and substantially parallel to each other;

left-hand side and right-hand side surfaces that are flat and extend at given angles that are opposite to each other with respect to said vertical plane, respectively, a groove of given depth and width that extends into the bottom surface perpendicularly to the vertical plane at middle distance from said front and rear surfaces between the left-hand side and right-hand side surfaces; and a tongue projecting from the top surface in a direction generally perpendicular to the vertical plane between the left-hand side and right-hand side surfaces, said tongue having a height equal to or smaller than the depth of the groove, said tongue also having a width which, at middle distance from said left-hand side and right-hand side surfaces, is substantially equal to or slightly smaller than the width of the groove, said width becoming smaller in size toward each of said left-hand side and right-hand side surfaces, respectively, whereby another block of the same structure can be stacked onto said block with the tongue of said block inserted into the groove of said another block and with the front surfaces of both of said blocks extending either parallel or at an angle with respect to each other as a function of the position given to said tongue within the groove of said another block.

2. The block of claim 1, wherein said groove and tongue have similarly tapering sidewalls.

3. The block of claim 2, wherein said front and rear surfaces have bevelled edges.

4. The block of claim 1, wherein said tongue extends at middle distance from said front and rear surfaces, respectively whereby, when said another block is stacked onto said block with the tongue of said block inserted into the groove of said another block and with the front surfaces of both of said blocks extending parallel, said front surfaces are coplanar.

5. The block of claim 4, wherein said tongue is diamond-shaped and has a long axis that extends perpendicular to said vertical plane, a short axis that extend within said vertical plane, and a pair of opposite apexes on said long axis that are cut into flat portions that are coplanar with said left-hand side and right-hand surfaces, respectively.

6. The block of claim 5, wherein said groove and tongue have similarly tapering sidewalls.

7. The block of claim 6, wherein said front and rear surfaces have bevelled edges.

8. The block of claim 5, said block being sized so that:

the ratio of the length of the front surface to the length of the rear surface is equal to about ⅔;

the ratio of the height of said front and rear surfaces to the length of said front surface is equal to about ½; and the ratio of the length of said front surface to the distance between said front and rear surfaces is equal to about 1.

9. The block of claim 6, said block being sized to so that:

the ratio of the length of the front surface to the length of the rear surface is equal to about ⅔;

the ratio of the height of said front and rear surfaces to the length of said front surface is equal to about ½; and the ratio of the length of said front surface to the distance between said front and rear surfaces is equal to about 1.

10. The block of claim 1, said block being sized so that:

the ratio of the length of the front surface to the length of the rear surface is equal to about ⅔;

the ratio of the height of said front and rear surfaces to the length of said front surface is equal to about ½; and the ratio of the length of said front surface to the distance between said front and rear surfaces is equal to about 1.

11. The block of claim 1, wherein said tongue is diamond-shaped and has a long axis that extends perpendicular to said vertical plane, a short axis that extend within said vertical plane, and a pair of opposite apexes on said long axis that are cut into flat portions that are coplanar with said left-hand side and right-hand surfaces, respectively.

12. A multiple retaining wall block unit comprising at least two blocks, each of said block comprising:

top and bottom surfaces that are flat and parallel to each other, each of said top and bottom surfaces being trapezoidal in shape and symmetrical with respect to a vertical plane;

front and rear surfaces that are transversal to said vertical plane and substantially parallel to each other, said front and rear surfaces having bevelled edges;

left-hand side and right-hand side surfaces that are flat and extend at given angles that are opposite to each other with respect to said vertical plane, respectively, a groove of given depth and width that extends into the bottom surface perpendicularly to the vertical plane at middle distance from said front and rear surfaces between the left-hand side and right-hand side surfaces; and a tongue projecting from the top surface in a direction generally perpendicular to the vertical plane between the left-hand side and right-hand side surfaces, said tongue having a height equal to or smaller than the depth of the groove, and a width while, at middle distance from said left-hand side and right-hand side surfaces, is substantially equal to or slightly smaller than the width of the groove, said width becoming smaller in size toward each of said left-hand side and right-hand side surfaces, respectively, said tongue being diamond-shaped and having a long axis that extends perpendicular to said vertical plane, a short axis that extend within said vertical plane, and a pair of opposite apexes on said long axis that are cut into flat portions that are coplanar with said left-hand side and right-hand surfaces, respectively, said groove and tongue having similarly tapering sidewalls;

said at least two blocks being integrally connected to each other in line with the front or rear surface of each of said blocks extending flat against the front or rear surface of every adjacent block, respectively whereby the bevelled edges of said front and rear surfaces make it possible for each of said blocks to be easily slitted and cut off from the remaining blocks.

13. The unit of claim 12, further comprising a pair of end pieces forming an integral part thereof, said end pieces extending flat against the front or rear surfaces of the blocks that extend at both ends of the unit, said end pieces having a height slightly smaller than the height of the blocks whereby said end pieces can be slitted and cut off directly from a bundle of said unit stacked with other similar units.

14. The unit of claim 13, wherein the tongue of each of said at least two blocks extends at middle distance from said front and rear surfaces, respectively.

15. A multiple retaining wall block unit comprising at least two blocks, each of said blocks comprising:

top and bottom surfaces that are flat and parallel to each other, each of said top and bottom surfaces being trapezoidal in shape and symmetrical with respect to a vertical plane;

front and rear surfaces that are transversal to said vertical plane and substantially parallel to each other, said front and rear surfaces having bevelled edges;

left-hand side and right-hand side surfaces that are flat and extend at given angles that are opposite to each other with respect to said vertical plane, respectively, and a groove of given depth and width that extends into the bottom surface perpendicularly to the vertical plane at middle distance from said front and rear surfaces between the left-hand side and right-hand side surfaces, said groove having tapering sidewalls;

said at least two blocks being integrally connected to each other in line with the front or rear surface of each of said blocks extending flat against the front or rear surface of every adjacent block, respectively, whereby the bevelled edges of said front and rear surfaces make it possible for each of said blocks to be easily slitted and cut off from the remaining blocks.

16. The unit of claim 15, further comprising a pair of end pieces forming an integral part thereof, said end pieces extending flat against the front or rear surfaces of the blocks that extend at both ends of the unit, said end pieces having a height slightly smaller than the height of the blocks whereby said end pieces can be slitted and cut off directly from a bundle of said unit stacked with other similar units.

* * * * *